US009049934B2

(12) United States Patent
Walker

(10) Patent No.: US 9,049,934 B2
(45) Date of Patent: Jun. 9, 2015

(54) RACK-MOUNTED SERVER SEAT

(76) Inventor: David Andrew Walker, Calgary (CA)

( * ) Notice: Subject to any disclaimer, the term of this patent is extended or adjusted under 35 U.S.C. 154(b) by 0 days.

(21) Appl. No.: 12/542,678

(22) Filed: Aug. 17, 2009

(65) Prior Publication Data

US 2010/0096893 A1 Apr. 22, 2010

Related U.S. Application Data

(63) Continuation of application No. PCT/IB2009/005854, filed on Apr. 22, 2009.

(30) Foreign Application Priority Data

Apr. 22, 2008 (CA) ..... 2629729

(51) Int. Cl.
*A47B 83/02* (2006.01)
*A47C 4/00* (2006.01)
*A47C 9/02* (2006.01)

(52) U.S. Cl.
CPC ..... *A47C 9/022* (2013.01)

(58) Field of Classification Search
USPC ..... 297/217.1, 217.3, 217.4, 217.7, 138, 297/143, 135, 160–162, 136, 140, 170; 312/223.2
See application file for complete search history.

(56) References Cited

U.S. PATENT DOCUMENTS

| | | | | | |
|---|---|---|---|---|---|
| 371,168 | A | * | 10/1887 | Boss | 297/143 |
| RE16,410 | E | * | 8/1926 | Woolman | 297/143 X |
| 2,824,598 | A | * | 2/1958 | Ertl | 297/143 |
| 4,736,998 | A | * | 4/1988 | Wilson et al. | 297/140 X |
| 4,880,270 | A | * | 11/1989 | Cooper | 297/188.21 |
| 5,056,864 | A | * | 10/1991 | Cooper | 297/188.21 |
| 5,388,032 | A | * | 2/1995 | Gill et al. | 700/17 |
| 5,547,270 | A | * | 8/1996 | Dang | 297/140 X |
| 5,673,968 | A | * | 10/1997 | Ponzio | 297/143 |
| 5,876,093 | A | * | 3/1999 | Williams | 297/174 R |
| 6,010,186 | A | * | 1/2000 | Tsay | 297/159.1 |
| 6,145,926 | A | * | 11/2000 | Lin | 297/217.3 |
| 6,209,952 | B1 | * | 4/2001 | Huang | 297/143 X |
| 6,403,897 | B1 | * | 6/2002 | Bluth et al. | 297/143 X |
| 6,428,124 | B1 | * | 8/2002 | Bluth et al. | 297/143 X |
| 6,641,213 | B1 | * | 11/2003 | Kuhn | 297/250.1 |
| 6,916,065 | B2 | * | 7/2005 | Park | 297/217.1 |
| 6,945,412 | B2 | * | 9/2005 | Felcman et al. | 211/26 |
| 7,134,719 | B2 | * | 11/2006 | Moglin et al. | 297/217.3 |
| 7,192,084 | B1 | * | 3/2007 | Huang | 297/143 X |
| 7,479,591 | B2 | * | 1/2009 | Wheeler et al. | 84/177 |
| 7,524,004 | B2 | * | 4/2009 | Nakamura et al. | 312/223.2 |
| 7,675,742 | B2 | * | 3/2010 | Wu et al. | 361/679.08 |
| 8,251,455 | B1 | * | 8/2012 | Midkiff et al. | 297/463.1 |
| 2004/0007907 | A1 | * | 1/2004 | DiRe | 297/217.3 |
| 2008/0100106 | A1 | * | 5/2008 | Dragusin | 297/217.3 |
| 2010/0320811 | A1 | * | 12/2010 | Lin et al. | 297/143 |

* cited by examiner

*Primary Examiner* — Rodney B White

(57) ABSTRACT

The disclosed invention solves the problem of fatigue, among other things, by providing a seat assembly that fits into one or more Unit Spaces in an electronic equipment rack.

12 Claims, 13 Drawing Sheets

RACK-MOUNTED SERVER SEAT

FIELD OF THE INVENTION

This invention relative to the field of compact, stowable seats for use in conjunction with racks, and in particular to a horizontally stowable folding seat adapted for mounting into racks including those used to hold servers, communications equipment and the like.

BACKGROUND OF THE INVENTION

Data center and computer room space is always at a premium but their efficient operation is critical to most businesses. Racks and rack-mounted equipment allow companies to maximize the use of this space but the comfort of IT support staff is sacrificed. When rack-mounted equipment is being installed, upgraded, monitored or requires other service, IT staff are required to stand for extended periods of time, and often in stressful situations, due to space saving or security requirements.

It is an object of the present invention to alleviate some of the discomfort of IT personnel working on rack-mounted servers, communications equipment or even other equipment such as audio-visual equipment or entertainment equipment which may be rack-mounted. It is also an object to provide a stable seating appliance in an area containing critical equipment that can be highly sensitive to any kind of impact such as a stand-alone chair falling over.

SUMMARY OF THE INVENTION

Consequently, the rack-mounted server seat according to the present invention provides a solution to the discomfort suffered by operators and server support staff in any area equipped with racked equipment such as a communications rack. In particular, operators are forced to stand for hours on end in front of a rack-mounted KMM (keyboard/monitor/mouse) with no ability to sit down. KMM's are designed to be used while standing, so a typical office or folding chair is unusable. Some have tried using a bar stool, but storage of these when not in use is a recognized problem because space is usually very limited, and if they are knocked over sensitive equipment may be damaged.

In summary then what is provided by the present invention is a stable rack-mounted or rack-mountable seat which stows neatly and space-efficiently out of the way within a rack space when the seat is not in use, and which quickly and easily deploys from the rack space when the seat is needed into a stable support stool or like seat which only minimally takes up space adjacent to the server rack.

In a further and preferred embodiment, a slide-out table is also mounted in, or mountable in, the rack adjacent the seat, for example above the seat when stowed in the rack space. Advantageously the seat includes a footrest bar or other footrest means beneath the seat, which also folds up under the seat for storage in the rack.

The present invention may thus be characterized in one aspect as including a deployable seat for mounting in a rack having upright posts defining a rack cavity, wherein the rack is adapted to provide a vertically extending array of adjacent horizontal rack spaces in which to mount rack-mountable components, and wherein the deployable seat includes:

a railing assembly for horizontal mounting in a rack space, an elongate rigid arm having opposite first and second ends, said first end of said arm slidably mounted in said railing assembly for selective sliding translation of said second end of said arm between a retracted position retracted into said rack space and an extended position cantilevered from said rack space, at least one elongate rigid leg having opposite first and second ends, said first end of said leg pivotally mounted to said second end of said aim for rotation of said second end of said leg between a storage position substantially parallel to said arm and lowered seat-supporting position when said second end of said leg is lowered downwardly in a downward are from said storage position to said seat-supporting position, wherein in said seat-supporting position a load applied downwardly to said second end of said arm, for example by a user sitting on the seat, is supported by compression of said leg vertically downward along said leg, wherein said seat is mounted at said second end of said arm and above, for example directly above, said first end of said leg for supporting the weight of the user sitting thereon.

In one embodiment the seat is mounted on a vertically displaceable seat height adjustment means. For example, the seat may be mounted on a rigid, substantially vertically selectively displaceable seat post whereby said seat may be selectively raised and lowered. The seat post may, for example, be slidably mounted to said first end of said leg or said second end of said arm. By way of further example, the seat post may be telescopically mounted in said first end of said leg, in which case said seat is pivotally mounted on said first end of said leg and pivotable through at least ninety degrees so as to be pivotable to a horizontal orientation when said leg is oriented in either said storage position or said seat-supporting position.

In a further embodiment said awl includes a spaced apart parallel pair of arms having an elongate leg storage space therebetween, and wherein said first end of said leg is pivotally mounted between ends of said pair of arms at said second end of said arm, and wherein said leg, when in said storage position, is sandwiched between said pair of arms. When in said seat-supporting position said leg may be substantially vertical so as to rest said second end of said leg against a rigid floor surface. In yet a further embodiment, the at least one elongate rigid leg is a pair of legs. The pair of legs may be substantially parallel and may have a footrest supported by said pair of legs. The footrest may be a cross bar extending horizontally between a lower end of the pair of legs. The pair of legs may flair outwardly below the footrest for increased stability.

In a preferred embodiment a table stand is pivotally mounted to said arm and is also pivotal between a stowed position along said arm and a substantially vertical table supporting position so as to support a rigid table thereon. The table may be pivotally mounted to said table stand so as to be horizontal when said table stand is either vertical or horizontal for storage. Where the arm is a pair of arms, the table stand may also be sandwiched between the pair of arms when in its stowed position. The table stand may fold downwardly towards the seat and the table maintained horizontally when the table stand and table are folded for storage in the rack space.

BRIEF DESCRIPTION OF THE DRAWINGS

In the accompanying illustration wherein similar characters are referenced to note corresponding parts in each view.

DETAILED DESCRIPTION OF EMBODIMENTS OF THE INVENTION

Figure 1:
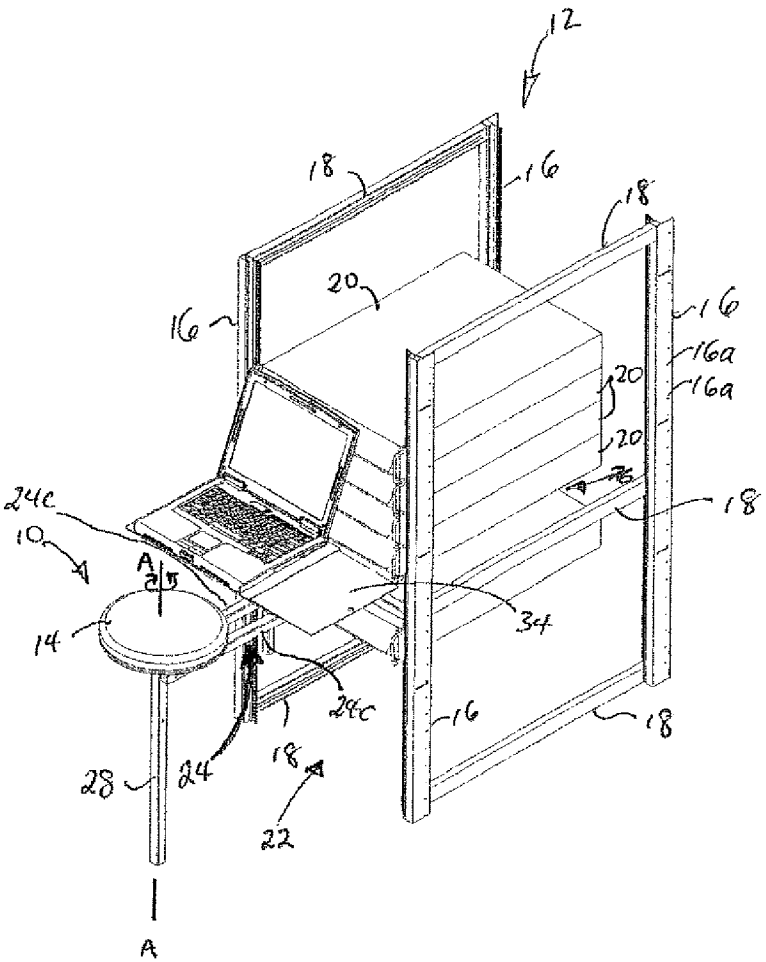
FIG. 1 is, in perspective view, a component rack having a server seat according to one embodiment of the present invention deployed therefrom, and a utility table mounted to the deployable seat assembly.
Figure 2:
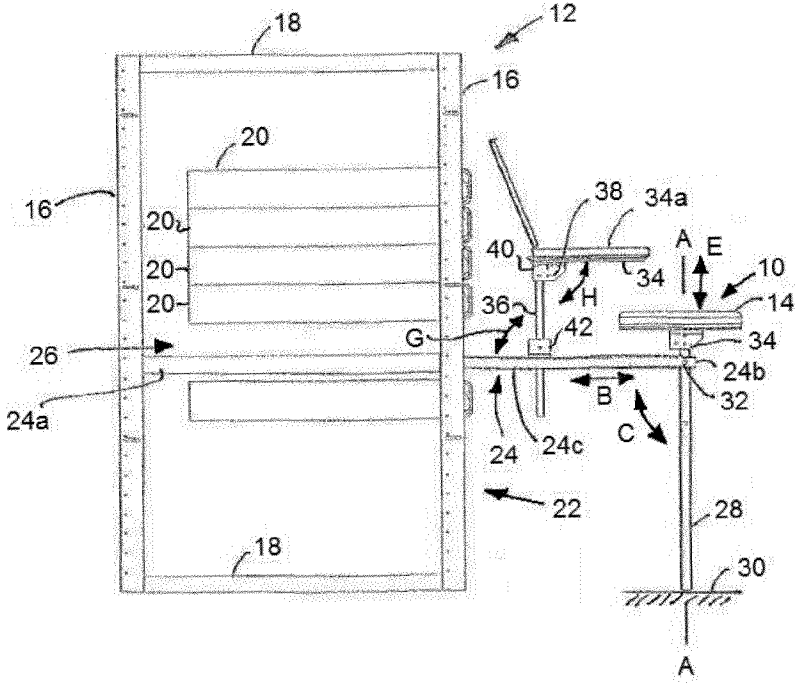
FIG. 2 is, in left side elevation view, the rack, seat, seat assembly, and utility table of FIG. 1.
Figure 3:
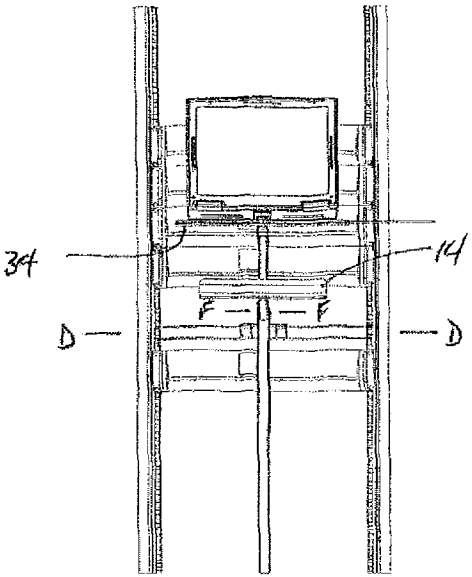
FIG. 3 is, the view of FIG. 2 in front elevation view.
Figure 5:
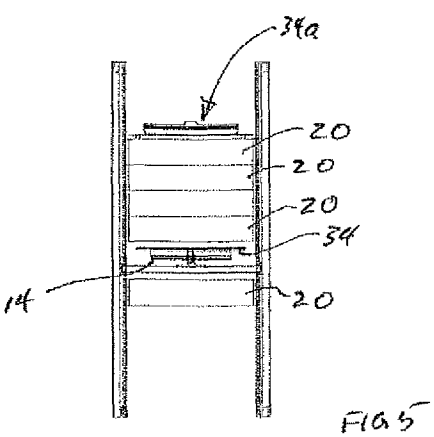
FIG. 5 is the view of FIG. 4 in front elevation view.
Figure 4:
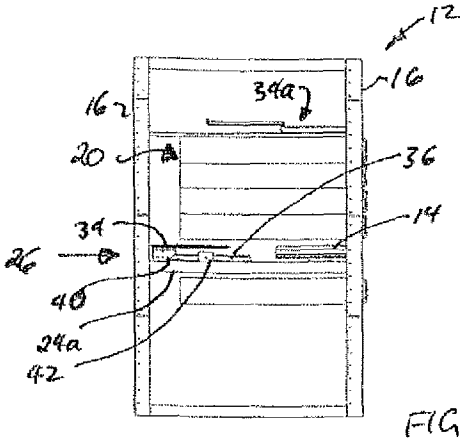
FIG. 4 is, in left side elevation view, the rack, seat, seat assembly, and table of FIG. 1 with the seat assembly and table stowed within a rack in the rack.
Figure 6:
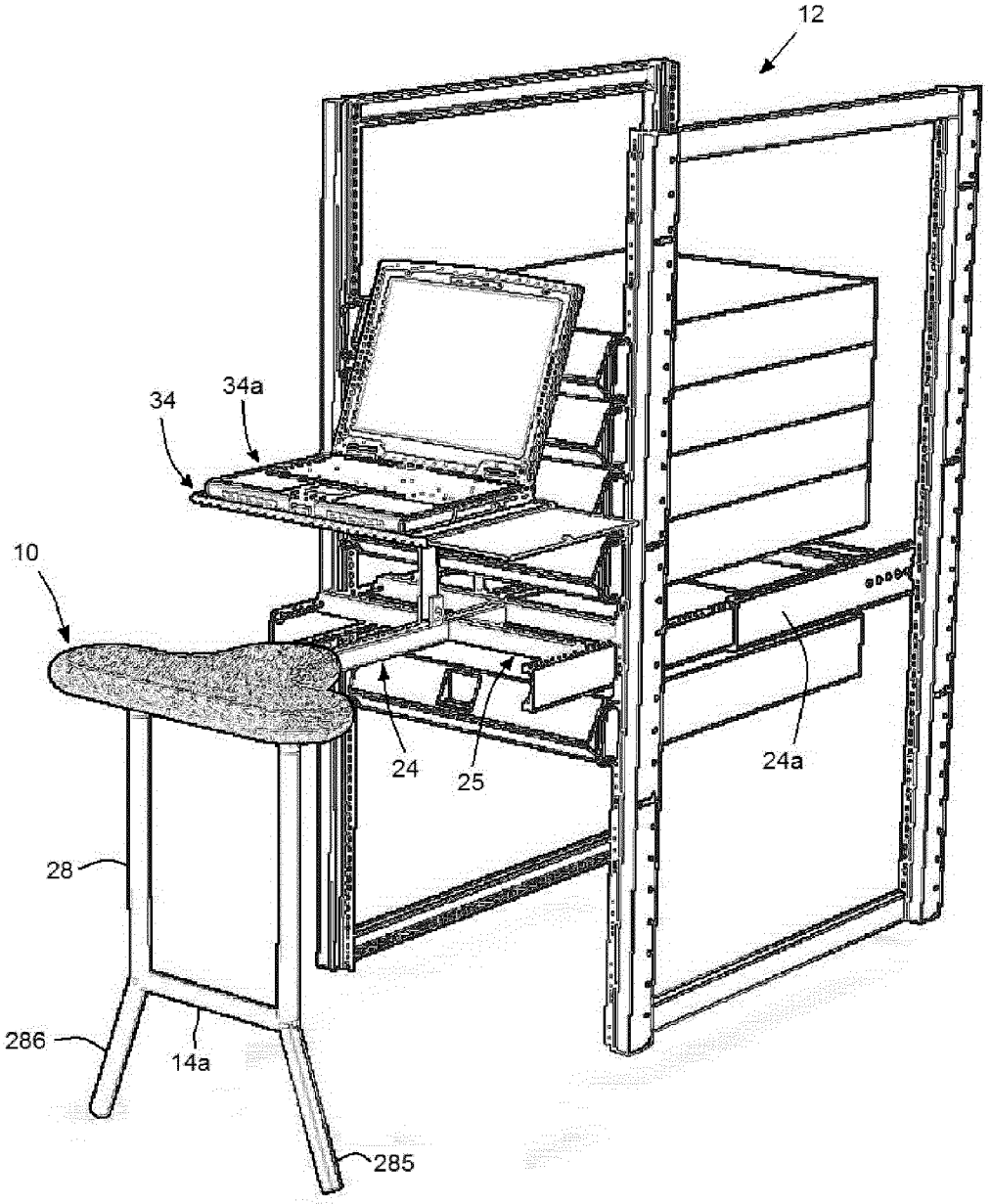
FIG. 6 is, in right side perspective view, a component rack having a server seat according to a further embodiment of the present invention.
Figure 6A:
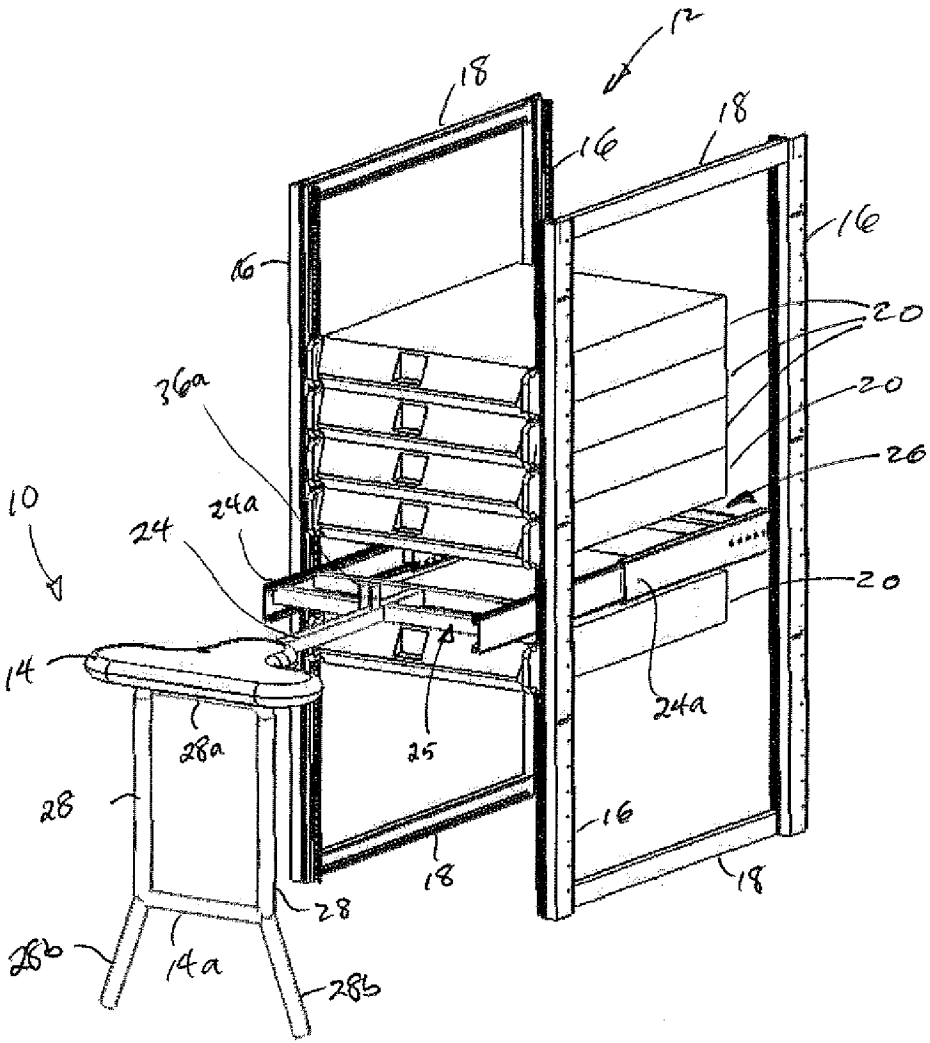
FIG. 6*a* is the view of FIG. 6 with the table removed.
Figure 6B:
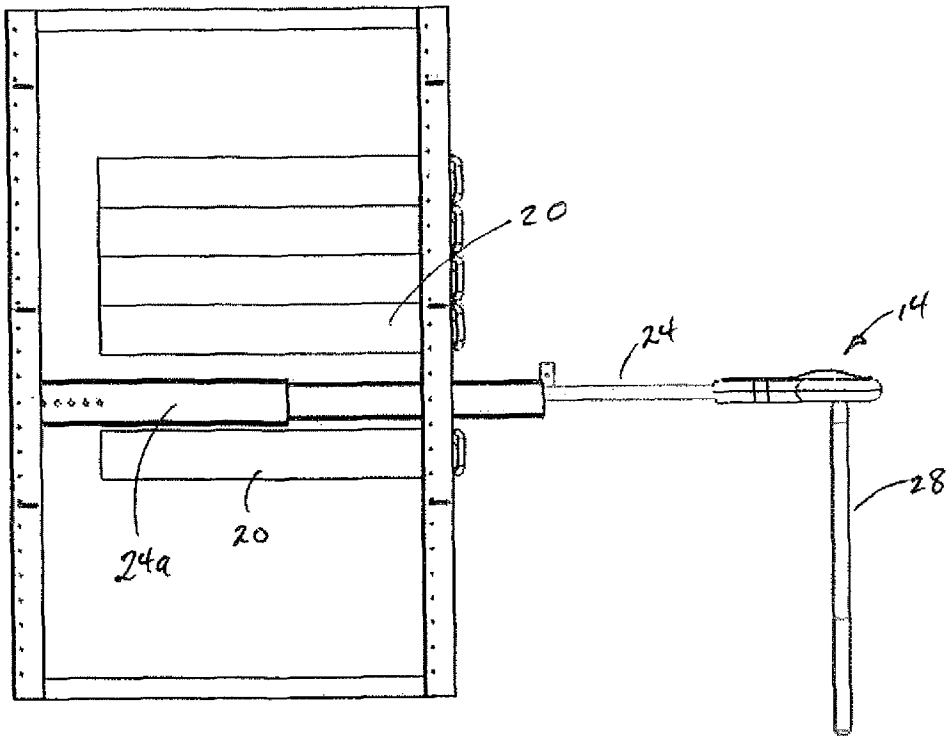
FIG. 6*b* is the server seat of FIG. 6*a* in side elevation view.
Figure 7:
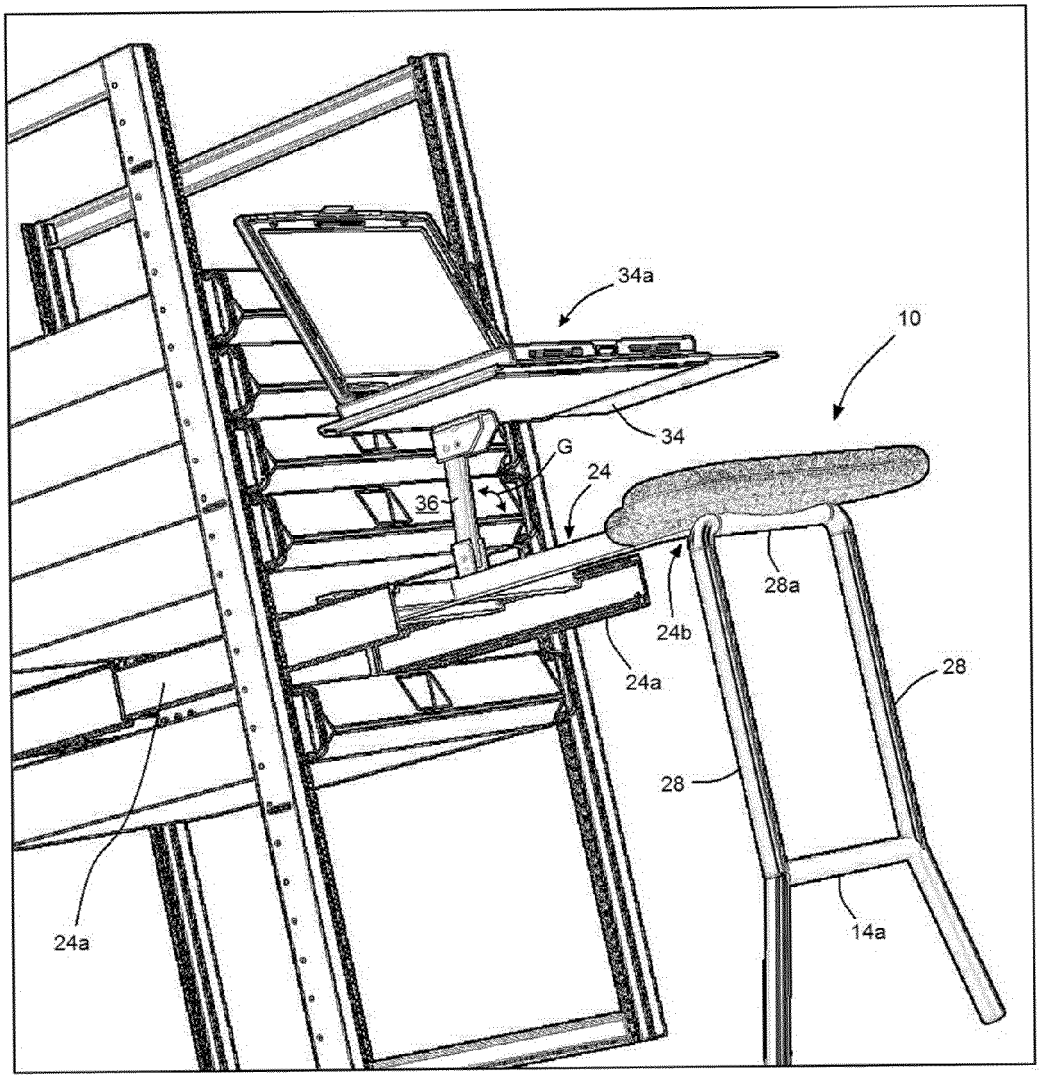
FIG. 7 is, in left side perspective, the server seat of FIG. 6.
Figure 8:
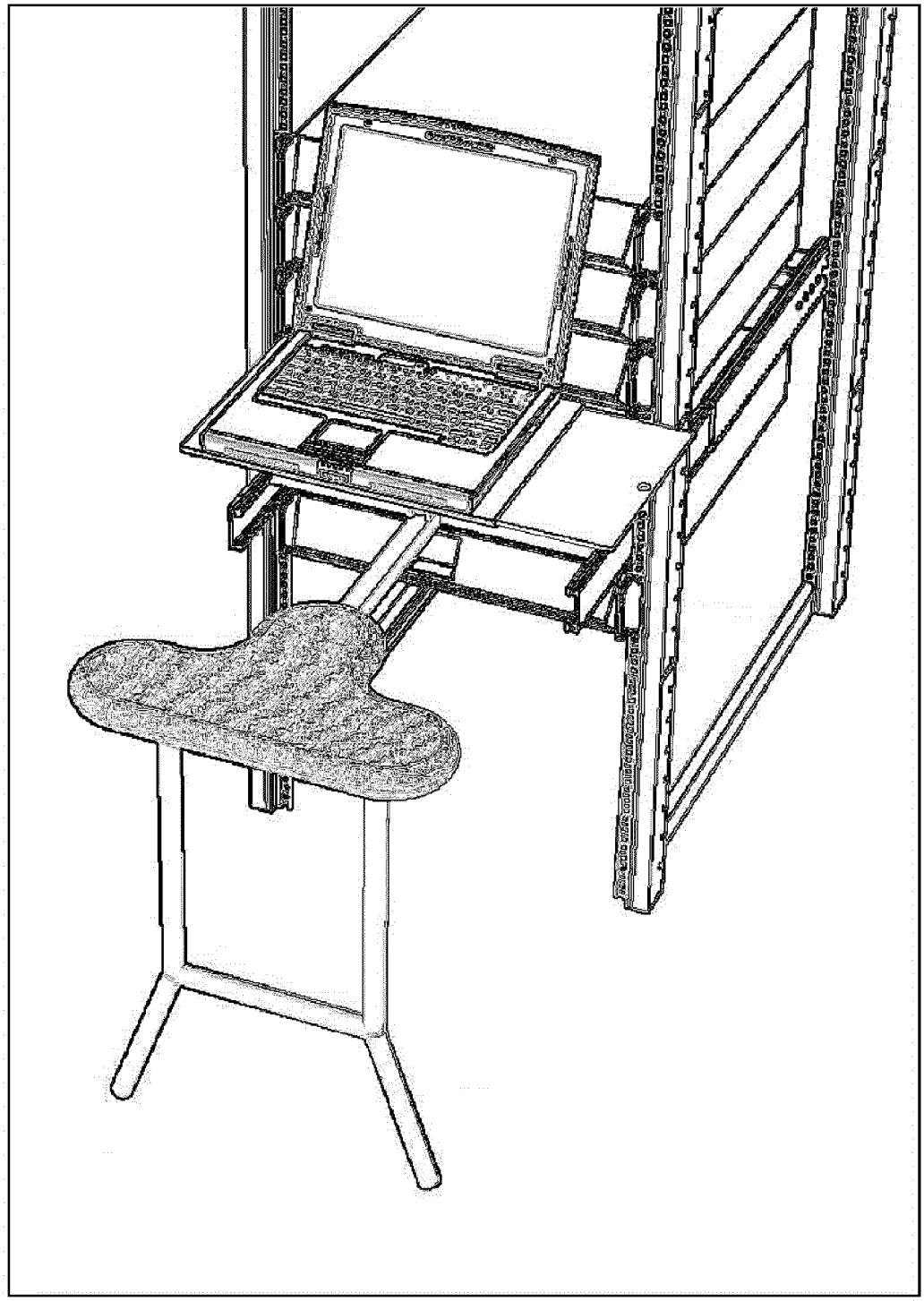
FIG. 8 is a top perspective of the server seat of FIG. 6.
Figure 9:
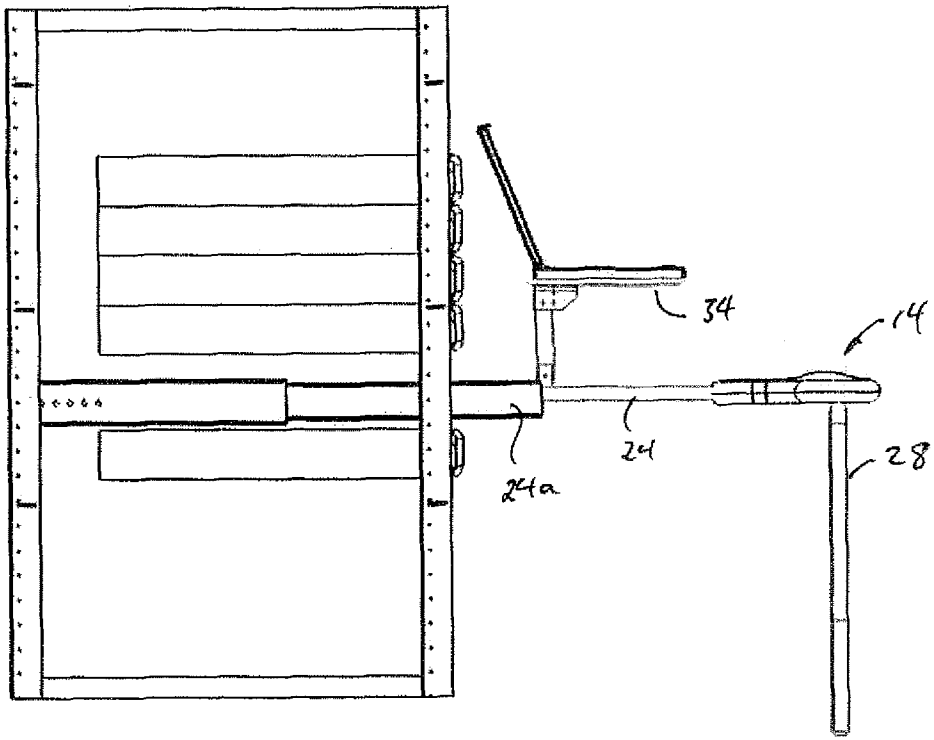
FIG. 9 is the view of FIG. 6*b* with the table mounted on the arm.
Figure 10:
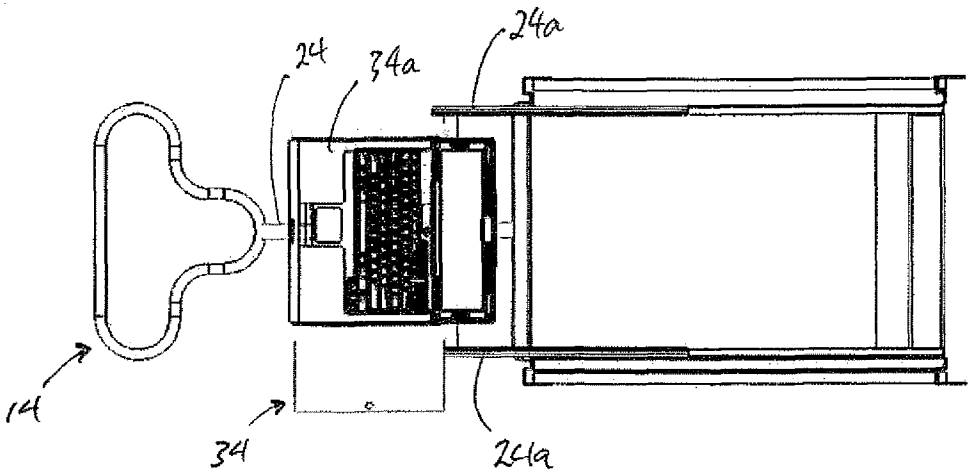
FIG. 10 is the server seat of FIG. 9 in top planform view.
Figure 11:
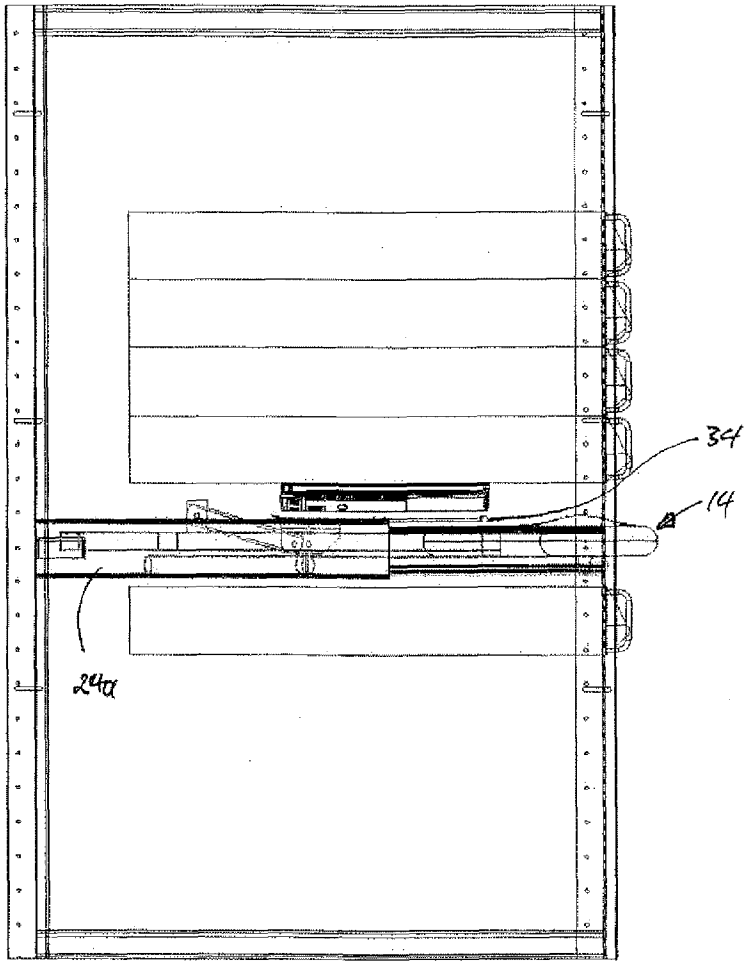
FIG. 11 is, in side elevation view, the server seat of FIG. 9 in its stowed position within the server rack.
Figure 12:
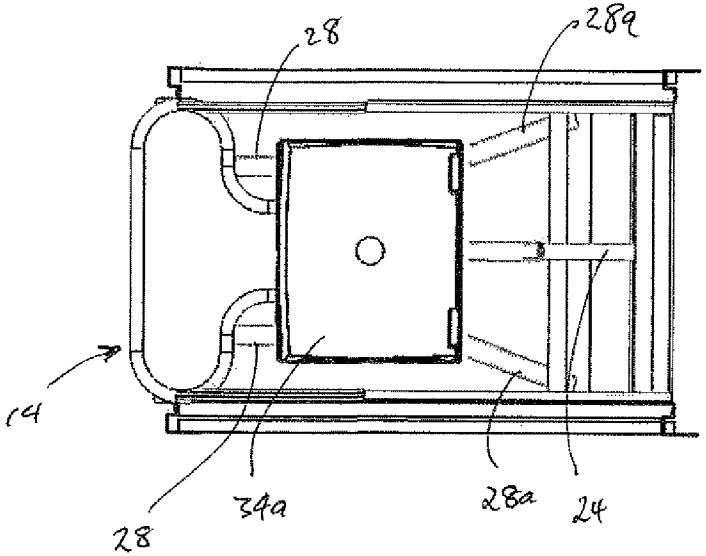
FIG. 12 is, in top planform view, the server seat of FIG. 11.

The rack-mounted server seat according to the present invention is in one embodiment a foldable stool 10 that can be anchored to any four post rack including for example a standard 19 inch wide four-post communications rack 12. When not in use, stool 10 slides into rack 12 for storage. Examples of applicable racks come in 42 u and 22 u configurations. The server seat assembly is designed to take up only 2 u (that is, 3.5 inches vertically). It may also in one embodiment be adjustable in height as described below to accommodate users of varying height. The assembly includes an ergonomic, padded seat 14 and may include a footrest 14*a* as seen in the embodiment of FIG. 6 onwards. By allowing the seat to swivel about vertical axis A the present invention also offers the option of using a server seat assembly as an easy-to-store chair for use in non-KMM environments. This also allows server seat assemblies to be used in pairs when it is desired that there be more than one user at a time.

Rack 12 includes four up-standing posts 16 stabilized by cross-members 18. Posts 16 each have an array of holes 16*a* or the like to allow for individual rack-mounted components 20, to be mounted laterally across the front opening 22 into rack 12 so as to mount each component 20 in for example a vertically adjacent stack as illustrated, and so as to extend laterally across and braced between at least the front-most posts 16.

Conventionally, the amount of vertical space each component 20 occupies between posts 16 is gauged by a number of units "u", for example, blade-like server elements for example might only occupy 2*u* height units within the rack, allowing many closely vertically adjacent components 20 to be mounted in a single stacked array in rack 12. This provides efficient and densely packed equipment for example server components or communications components.

Thus as stated above, because space is typically at a premium, it is an improvement over prior art stools or seats to provide a slide-out seat which, when collapsed and stowed, fits into only a 2 u space in a rack 12. As may be seen in the accompanying illustrations, this is accomplished in the present invention by a horizontal slide-out arm assembly 24 which slides on runners, rails 24*a* or the like supported by cross-arms 25. Rails 24*a* are mounted horizontally front-to-back in rack 12 so that horizontal arm assembly 24 and cross-arms 25 may be extended from, or retracted in direction B into corresponding rack space 26. When arm assembly 24 is extended from between posts 16 so as to be cantilevered fully outwardly, a single leg 28 in the embodiment of FIGS. 1-5 or a parallel pair of legs 28 in the embodiment of FIG. 6 onwards may be deployed from the horizontal i.e. storage position which leg(s) 28 occupy when stowed within rack space 26, downwardly in direction C about axis of rotation D so as to form a vertically depending rigid support extending between the distal end 24*b* of arm assembly 24 and the floor 30. Leg(s) 28 may be pivotally mounted to distal end 24*b* by means of a shaft or pins 32 forming a swing pivot for relative rotational movement between leg(s) 28 and arm assembly 24.

In the embodiment of FIGS. 1-5, seat 14 is rotatably mounted on the upper end of leg 28 by means of, in one embodiment, a telescopically mounted seat post 32 which is telescopically mounted within the hollow upper end of leg 28 so that seat 14 may be adjusted vertically in direction E by telescoping seat post 32 into or out of the upper end of leg 28, for example, in the manner of adjusting a bicycle seat. Seat 14 is pivotally mounted to the upper most end of seat post 32 for rotation about axis of rotation F on shaft or pins 34. Seat 14 rotates about axis F so that it may be maintained in a horizontal aspect for both storage in rack space 26 and for use while deployed. In the embodiment of FIG. 6 onwards, seat 14 is mounted flat on the distal end 24*b* of arm 24 and the pair of legs 25 having an upper cross-bar 28*a* is rotatably mounted under the seat.

Thus when stool 10 is deployed, the weight of a user sitting on seat 14 is born primarily by the downward compression of leg(s) 28 against floor 30. Thus minimal if any bending moment is applied to distal end 24*b* of arm assembly 24 so that little if any torsional stress is transmitted to rails 24*a*. When the user has completed their task at rack 12, stool 10 may be stowed by, in the first embodiment, simply lowering seat 14 and, in both embodiments, pivoting leg(s) 28 upwardly in a direction reversed to direction C so as to, in the first embodiment, nest leg 28 between arms 24*c*, leg 28 being pivotally mounted between the distal ends of arms 24*c*. Thus with leg 28 rotated up to the horizontal and resting between the pair of arms 24*c*, and with seat 14 rotated relative to leg 28 so as to remain horizontal, arm assembly 24 and leg 28 may be slid inwardly into rack space 26 along rails 24*a* until seat 14 is completely enclosed within rack space 26, that is, enclosed between the four posts 16.

In a first preferred embodiment, a rigid table top 34 is mounted atop a table post 36. In the first embodiment, table post 36 is pivotally mounted between arms 24*c*, and in the second embodiment of FIG. 6 onwards is pivotally mounted on flanges 36*a* atop the single arm 24, for rotation in direction G between a vertical position supporting table top 34 horizontally so as to support for example a laptop computer 34*a* thereon, and a horizontal position flush between arms 24*c* for storage of table top 34 and table post 36 when arm assembly 24 is stowed in rack space 26. Table top 34 is pivotally mounted to the upper end of table post 36 for rotation in direction H between its horizontal position and its stowed horizontal position folded down onto arm assembly 24 when stored within rack space 26. When table top 24 is in the deployed position atop table post 36, pins 38 or the like may be inserted through corresponding holes in brackets 40 so as to releasably lock table top 34 cantilevered horizontally outwardly from the upper end of table post 36 when in its vertical deployed position.

In particular, in the embodiment of FIG. 6 onwards legs 28 are two vertical supports with a horizontal support joining them that also acts as a footrest 14*a*. The lower legs 28*b* are hinged at the footrest 14*a* and cross-support 28*a* on the base of the seat so fold twice for storage. The table support folds down towards the seat as the table rotates to a flat position. The table then slides forward along the support so that it is out of the way of the user's knees if not in use.

In a preferred embodiment, table post 36 may be vertically adjusted so as to adjust the vertical height of table top 34, for example, by means of releasable lock or latch in brackets 42 which pivotally mount table post 36 between arms 24*c*.

As will be apparent to those skilled in the art in the light of the foregoing disclosure, many alterations and modifications are possible in the practice of this invention without departing from the spirit or scope thereof.

The invention claimed is:

1. A rack mounted deployable seat for mounting in a rack having upright posts defining a rack cavity, wherein the rack is adapted to provide a vertically extending array of adjacent horizontal rack spaces in which to mount rack-mountable components, and wherein said deployable seat comprises:

a railing assembly for horizontal mounting in a rack space, an elongate rigid arm having opposite first and second ends, said first end of said arm slidably mounted in said railing assembly for selective horizontal sliding translation of said second end of said arm between a retracted position retracted into said rack space and an extended position substantially horizontally cantilevered from said rack space, a substantially horizontal seat mounted on said second end of said arm, at least one elongate rigid leg having opposite first and second ends, said first end of said leg pivotally mounted to said second end of said arm for rotation of said second end of said leg between a storage position substantially parallel to said arm and lowered seat-supporting position when said second end of said leg is lowered downwardly in a downward arc from said storage position to said seat-supporting position, wherein in said seat-supporting position a load applied downwardly to said second end of said arm, by a user sitting on said seat, is supported by compression of said leg vertically downward along said leg, wherein said seat is above and mounted substantially horizontally to, said first end of said leg for supporting the weight of the user sitting thereon, and wherein said seat is sized to fit entirely within said rack space on said second end of said arm in said retracted position; and wherein said seat is telescopically mounted in said first end of said leg, and wherein said seat is pivotally mounted on said first end of said leg and pivotable through at least ninety degrees so as to be pivotable to a horizontal orientation when said leg is oriented in either said storage position or said seat-supporting position.

2. The seat of claim 1 wherein said seat is mounted directly above said first end of said leg.

3. The seat of claim 1 wherein said seat is mounted on a vertically displaceable seat height adjustment means.

4. The seat of claim 3 wherein said seat height adjustment means includes a rigid, substantially vertically selectively displaceable seat post, whereby said seat may be selectively raised and lowered.

5. The seat of claim 1 further comprising a seat post supporting said seat, wherein said seat post is slidably mounted to said first end of said leg or said second end of said arm.

6. The seat of claim 1 wherein said arm includes a spaced apart parallel pair of areas having an elongate leg storage space therebetween, and wherein said first end of said leg is pivotally mounted between ends of said pair of arms at said second end of said arm, and wherein said leg, when in said storage position, is sandwiched between said pair of arms.

7. The seat of claim 1 wherein in said seat-supporting position said leg is substantially vertical so as to rest said second end of said leg against a rigid floor surface.

8. The seat of claim 1 wherein said at least one elongate rigid leg is a pair of legs.

9. The seat of claim 8 wherein said pair of legs is substantially parallel and further comprising a footrest supported by said pair of legs.

10. The seat of claim 9 wherein said footrest includes a cross bar extending horizontally between a lower end of said pair of legs and wherein said pair of legs flair outwardly below said footrest for increased stability.

11. The seat of claim 1 further comprising a table stand pivotally mounted to said arm so as to be pivotal between a stowed position along said arm and a substantially vertical table supporting positions, and a table pivotally mounted to said table stand so as to be horizontal when said table stand is either vertical or horizontal for storage.

12. The seat of claim 11 wherein said arm is a spaced apart, parallel pair of arms, and wherein said table stand is sandwiched between said pair of arms when in said stowed position, and wherein said table stand folds downwardly towards said seat and wherein said table is maintained horizontally when said table stand and said table are folded for storage in the rack space.

* * * * *